US010493764B2

(12) United States Patent
Leiser et al.

(10) Patent No.: US 10,493,764 B2
(45) Date of Patent: Dec. 3, 2019

(54) FLUIDIC INTERFACE

(71) Applicant: HEWLETT-PACKARD DEVELOPMENT COMPANY, L.P., Houston, TX (US)

(72) Inventors: Judson M Leiser, Corvallis, OR (US); James Hankins, Corvallis, OR (US); Michael A Johnston, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 53 days.

(21) Appl. No.: 15/327,273

(22) PCT Filed: Jul. 28, 2014

(86) PCT No.: PCT/US2014/048424

§ 371 (c)(1),
(2) Date: Jan. 18, 2017

(87) PCT Pub. No.: WO2016/018216

PCT Pub. Date: Feb. 4, 2016

(65) Prior Publication Data

US 2017/0165973 A1 Jun. 15, 2017

(51) Int. Cl.
*B41J 2/175* (2006.01)

(52) U.S. Cl.
CPC ..... *B41J 2/17509* (2013.01); *B41J 2/175* (2013.01); *B41J 2/17523* (2013.01)

(58) Field of Classification Search
CPC ..... B41J 2/17523; B41J 2/17513; B41J 2/17509; B41J 2/1752; B41J 2/17553; B41J 2/175; B41J 2/17503; B41J 2/17566
USPC ..... 347/7, 84, 85
See application file for complete search history.

(56) References Cited

U.S. PATENT DOCUMENTS

| | | | |
|---|---|---|---|
| 6,045,207 | A | 4/2000 | Mochizuki et al. |
| 6,113,229 | A | 9/2000 | Gunther et al. |
| 6,196,673 | B1 | 3/2001 | Takahashi |
| 6,286,949 | B1 | 9/2001 | Lewis et al. |
| 6,422,693 | B2 | 7/2002 | Pawlowski et al. |
| 6,511,165 | B1 | 1/2003 | Barinaga et al. |
| 6,702,434 | B2 | 3/2004 | Barinaga et al. |
| 8,070,274 | B2 | 12/2011 | Steinmetz et al. |
| 8,591,014 | B2 | 11/2013 | Leiser et al. |
| 2004/0066433 | A1 | 4/2004 | Pingrey et al. |
| 2009/0084314 | A1 | 4/2009 | Matsuyama |
| 2012/0256985 | A1 | 10/2012 | Kobayashi |
| 2013/0111986 | A1 | 5/2013 | Leiser et al. |

FOREIGN PATENT DOCUMENTS

| | | |
|---|---|---|
| CN | 202573288 U | 12/2012 |
| EP | 1116592 | 7/2001 |
| EP | 2095961 | 9/2009 |

(Continued)

OTHER PUBLICATIONS

Ink Jet Printer Providers Consistent Coders in Any Setting http://news.thomasnet.com/fullstory/Ink-Jet-Printer-provides-consistent-codes-in-any-setting-820224.

*Primary Examiner* — Jannelle M Lebron
(74) *Attorney, Agent, or Firm* — HP Inc. Patent Department

(57) ABSTRACT

A fluidic interface may include a fluidic needle of a first polymer based compound and a body wall that is to support the fluidic needle, the body wall of a second polymer based compound, different than the first polymer based compound.

20 Claims, 4 Drawing Sheets

(56) References Cited

FOREIGN PATENT DOCUMENTS

| | | | |
|---|---|---|---|
| JP | 57131565 | | 8/1982 |
| JP | 60-107360 | A | 6/1985 |
| JP | 0392356 | | 4/1991 |
| JP | 11-268268 | A | 10/1999 |
| JP | 2005262646 | | 9/2005 |
| JP | 2008213253 | | 9/2008 |
| JP | 2009101704 | | 5/2009 |
| JP | 2010-99985 | A | 5/2010 |
| JP | 2011-16233 | A | 1/2011 |
| JP | 2012196776 | | 10/2012 |
| TW | 200918337 | A | 5/2009 |

FLUIDIC INTERFACE

BACKGROUND

Fluid ejection devices such as printers use replaceable fluid supplies to provide and replenish fluid. The fluid ejection devices may be provided with permanent or semi-permanent printheads. The printheads and replaceable fluid supplies are mechanically and fluidically connected through a fluidic interface. The fluidic interface is part of the fluid ejection device to allow for installation of the supply into the fluid ejection device. Certain fluidic interfaces have a hollow fluidic needle that is inserted in the supply outlet when the supply is installed to the interface. The needle needs to robust enough to facilitate many subsequent fluidic connections with supplies during the lifetime of the fluid ejection device.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

In this description, fluidic interfaces are disclosed. A fluidic interface is part of a fluid ejection device. The fluidic interface is to fluidically connect to fluid supplies to receive fluid from the supplies. The fluid ejection device can be a high precision dispensing device such as a printer or digital titration device. The printer can be a two dimensional or three dimensional printer. For example, the fluid can be an ink, a three-dimensional printing agent or a laboratory fluid. The fluid ejection device includes a printhead and fluid chambers and channels that transport the fluid from the supply to the printhead. The printhead includes an array of nozzles, for example having a resolution of at least approximately 300 nozzles per inch. The printhead may include actuators to eject the fluid from the nozzles, for example thermal resistors or piezo resistors.

Figure 1:
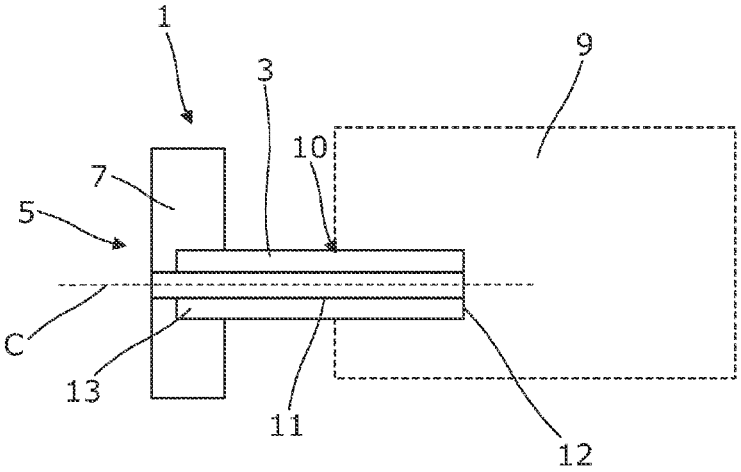
FIG. 1 illustrates a diagram of an example of a fluidic interface.

FIG. 1 illustrates a diagram of a cross section of an example of a fluidic interface 1 of a fluid ejection device, for connection to a replaceable fluid supply 9 through an outlet 10 of the supply 9. A replaceable fluid supply 9 is indicated in dotted lines for illustrative purposes. The fluidic interface 1 includes a fluidic needle 3 and a body 5 that supports the needle 3. Here the body 5 consists of a wall 7. The needle 3 has a central axis C. The needle 3 has an internal fluidic channel 11 to transport the fluid from an internal reservoir of the supply 9 towards further fluid channels of the fluid ejection device. The fluid is to be transported to a printhead of the fluid ejection device.

The needle 3 is retained and supported by the body wall 7 at its base 13. In the illustrated example, the body wall 7 surrounds the base 13 of the needle 3, thereby retaining and supporting the needle 3. The base 13 of the needle 3 is opposite to an insertion end 12 of the needle 3. The insertion end 12 is to be inserted in the fluid supply outlet 10 to withdraw fluid.

The fluidic interface 1 may comprise polymer based compounds. For example the polymer based compound includes a plastic resin with certain strengthening or filler additives. In the fluidic interface 1, the needle 3 is made of a first polymer based compound and the body 5 is made of a second polymer based compound that is different than the first polymer based compound. Each of the compounds can be chosen to match the requirements of the specific part.

On the one hand a fluidic needle 3 is typically relatively long and thin to allow for insertion in the fluid supply outlet 10. On the other hand, the needle 3 needs to repetitively absorb shocks and loads, during the lifetime of the fluid ejection, at least during each insertion into a supply 9. For example, a first compound having an increased hardness with respect to the second compound is chosen for the needle 3. For example, the body 5 is a single cast structure that is generally larger than the fluidic needle 3. For example a second compound of relatively low cost may be used for the body 5.

Using a common resin for the needle 3 and the body 5 may aid in obtaining a suitable bond. For example the bulk resin is PET (Polyethylene Terephthalate) or recycled PET. In one example, additives of the first compound include carbon fibers, for example to increase a hardness of the needle 3. Additives of the second compound can include glass fibers. For example, the glass fibers may give the body 5 certain cost advantages or electrical isolation properties.

Figure 2:
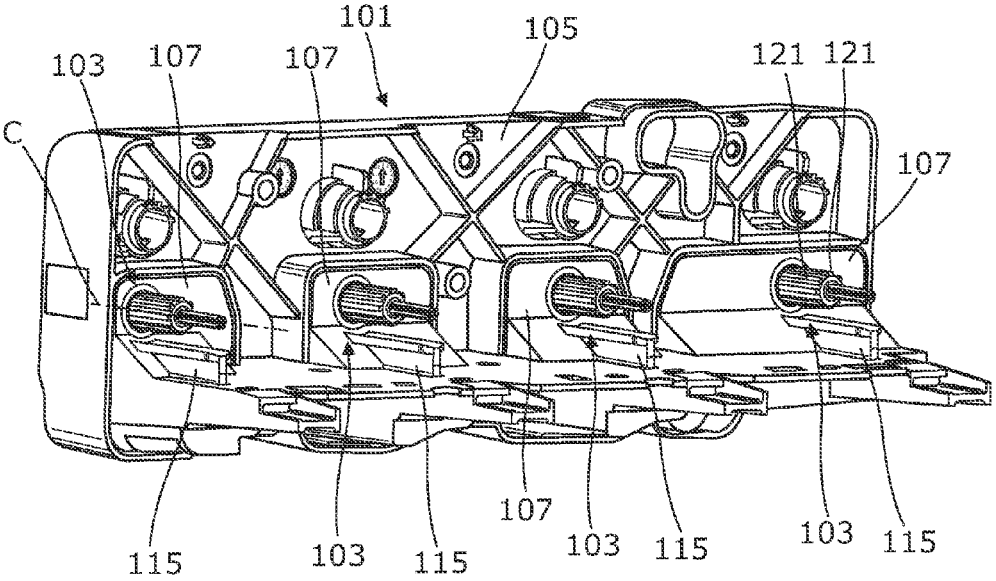
FIG. 2 illustrates a perspective view of an example of a fluidic interface.

FIG. 2 illustrates an example of a fluidic interface 101. The fluidic interface 101 is to be permanently mounted to a fluid ejection device. The fluidic interface 101 includes a main body 105 and four fluidic needles 103, for insertion to respective fluid supplies. For example each needle 103 is to be connected to an ink supply of a respective color, where each ink is to be transported to corresponding printhead nozzles through an arrangement of chambers and channels downstream of the needle 103. In other examples, the body 105 may support a different number of needles 103, for example one, two, three or more than four needles. Each of the needles 103 protrudes from a respective wall 107 of the body 105. The body 105 may include further interface elements such as a rail 115 to guide a supply towards the needle 103. One rail 115 may be provided per needle 103, parallel to a central axis of the needle 103.

The body 105 may be a single cast, integrally molded structure. The needle 103 may be a different single cast, integrally molded structure. The needles 103 are made of a first polymer based compound. The body 105 is made of a second polymer based compound, different than the first polymer based compounds.

Figure 3:
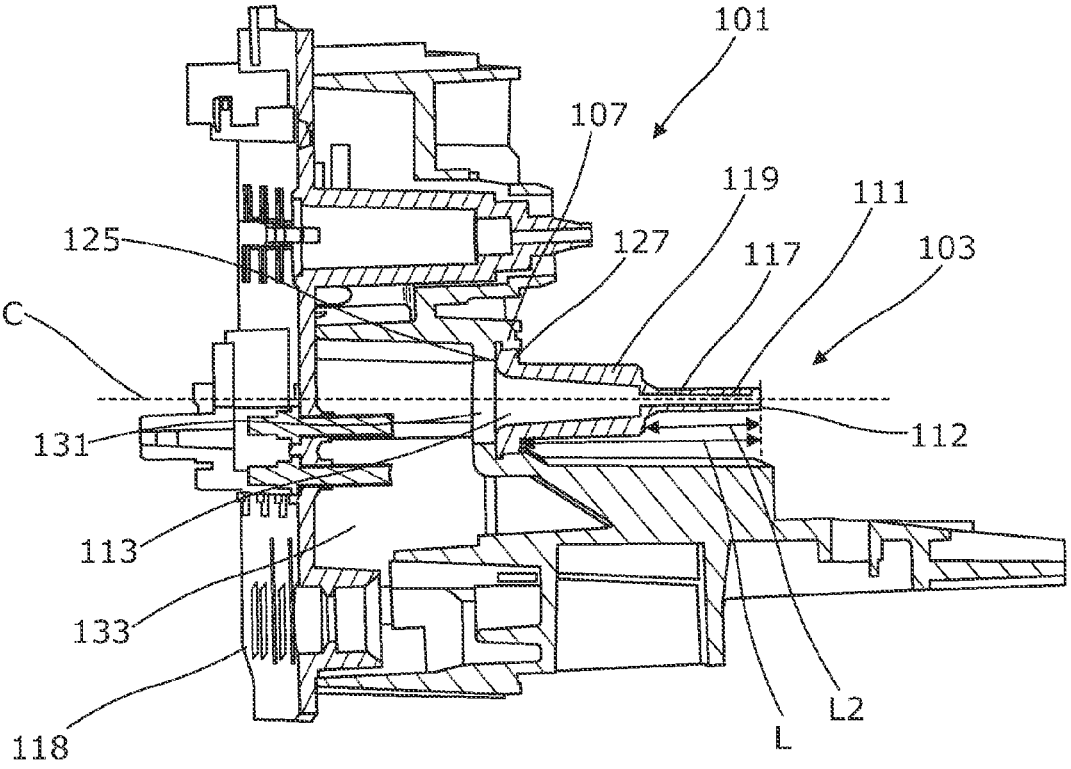
FIG. 3 illustrates a cross sectional view of an example of a fluidic interface.
Figure 4:
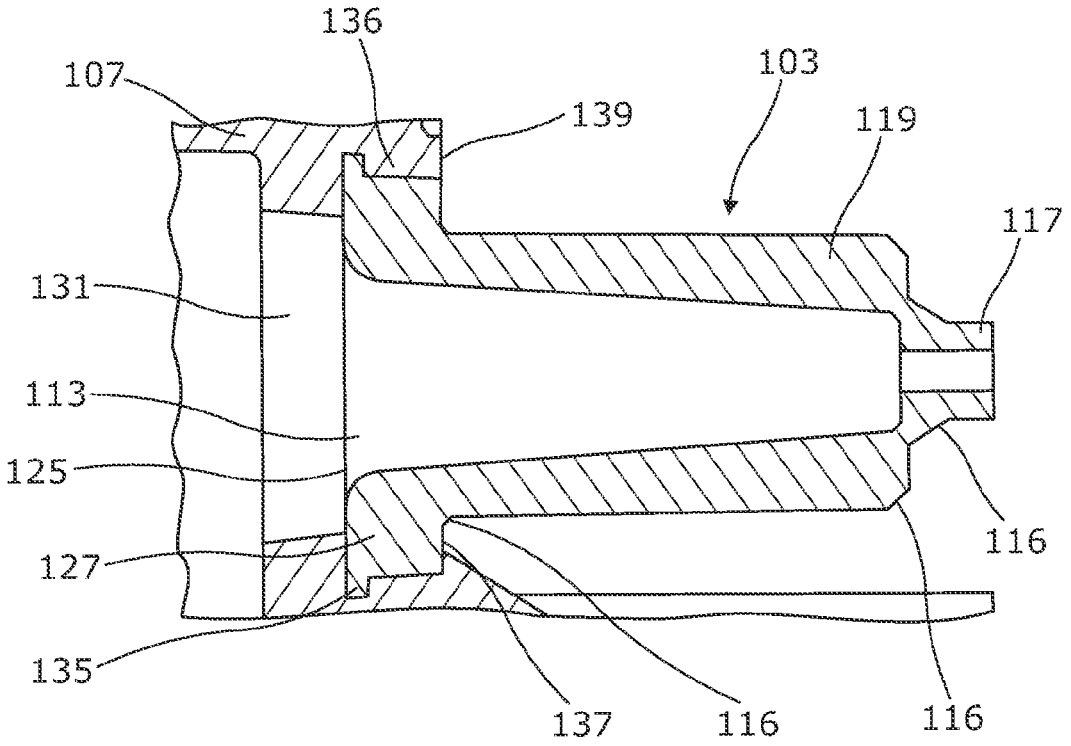
FIG. 4 illustrates a cross sectional side view of a detail of the example fluidic interface of FIG. 3.

FIG. 3 illustrates a cross sectional view of the example fluidic interface 101. FIG. 4 illustrates a detail of the cross sectional view of FIG. 3, wherein the needle 103 has been truncated. A plane of the cross section is parallel to the central axis C of the needle 103, for example the section plan runs vertically through the central axis C of the respective needle 103, in an upright vertical orientation of the fluidic interface 101. The body 105 and needle 103 are of the same design as the body 105 and needles 103 of the example of FIG. 2.

A length L of the needle 103, as measured between a front surface of the body wall 107 and the insertion end 112, can be between approximately 8 and 40 millimeters, for example between approximately 12 and 28 millimeters, for example between approximately 18 and 25 millimeters.

The needle 103 includes a thin insertion portion 117 to insert the needle 103 in a fluid supply outlet, to withdraw fluid from the supply. For example, the outer diameter of the insertion portion 117 is between approximately 1.2 and 3.5 millimeters. For example a length L2 of the insertion portion 117 is between approximately 5 and approximately 20 millimeters, for example between approximately 7 and 14 millimeters, as measured between the insertion end 112 and a boss 119. For example, the insertion portion 117 is to be inserted entirely or almost entirely into a supply. A cylindrical outer surface of the insertion portion 117 may have a subtle conical shape that converges towards an the insertion end 112 of the needle 103, for example over an angle of less than 5° or less than 3° with respect to the central axis C.

The needle 103 includes a boss 119 downstream of the insertion portion 117, which entails a substantial widening of the diameter. A maximum outer diameter of the boss 119 may be between approximately 4 and approximately 10 millimeter. The boss 119 may generally strengthen the needle 103. Ribs 121 may be provided in and around the boss 119, parallel to the central axis C, for example for additional strengthening, as best visible in FIG. 2. The boss 119 may also be adapted to mate with a corresponding hollow feature of a supply, around the outlet of the supply, during the insertion, to release some of the load from the insertion portion 117.

An internal fluid channel 111 of the needle 103 extends along the central axis C, from a mouth at the insertion end 112 up to a base 113 of the needle 103. Within the insertion portion 117 of the needle 103, the fluid channel 111 may be substantially straight and relatively thin, for example having a diameter of between approximately 0.3 and 2 millimeters. In an example the fluid channel 111 slightly widens towards the insertion end 112 within the insertion portion 117. Within the boss 119 the fluid channel 11 may have a more pronounced conical shape in the other direction, for example widening up towards a foot surface 125 of the base 113, thereby allowing for better fluid flow. The wall 107 of the body 105 has a through hole 131 into which the fluid channel 111 opens. Downstream of the through hole 131, the body 105 includes a fluid chamber 133 to receive the fluid, from where the fluid may flow towards a printhead.

In the illustrated example the base 113 of the needle 103 has the form of a flange 127. The flange 127 forms an abrupt widening of the needle 103 near the base 113, with respect to the boss 119. For example the diameter of the flange 127 may be at least 1 millimeter, at least 2 millimeters or at least 3 millimeters wider than the maximum diameter of the boss 119. The flange 127 extends within the wall 107 of the body 105. The flange 127 is surrounded and retained by the through hole 131 in the wall 107. In other examples, the base 113 need not be flange-shaped.

In FIG. 3 the body 105 is mounted to a mount structure 118. For example the mount structure 118 is part of a fluid ejection device frame and/or facilitates mounting of the body 105 in a fluid ejection device. The fluid chamber 133 may be shaped and delimited by the body 105 and the mount structure 118. In the illustrated example the mount structure 118 defines a back wall of the fluid chamber 133 and the body 105 defines the other walls of the fluid chamber 133. Two electrodes 131 are provided that protrude from the mount structure 118 into the fluid chamber 133, for example to sense ink level and/or other fluid properties.

As best illustrated in FIG. 4, the needle 103 may further include tapered (e.g. conical or rounding) transition portions 116 between each of said segments, i.e. between the insertion portion 117 and boss 119, and between the boss 119 and flange 127 to allow for a suitable molding process and mold release while avoiding deformations such as cracks.

As illustrated, a wider, downstream section 135 of the flange-shaped base 113 inside the wall 107 has a larger diameter than a narrower, upstream section 137 of the flange-shaped base 113 at the front surface 139 of the wall 107, wherein the diameter of the sections 135, 137 is measured perpendicular to a central axis C. The downstream section 135 may include a step or other widening feature. Correspondingly the body wall 107 includes a ring shaped structure 136 that retains the wider section 135 and holds and/or compresses the rest of the flange 127. The ring shaped structure 136 is integral to the rest of the wall 107. The wider downstream section 135 at the foot of the base 113 may provide for a reliable position of the needle 103 within the wall 107 during repetitive insertion in a fluid supply during the lifetime of the fluid ejection device. In another example that is not illustrated the base 113 could be conically shaped, widening towards the foot surface 125, thereby also providing for a wider section inside the wall 107.

The base 113 of the needle 103 is fitted in the wall 107. In an example the wall 107 has been molded around the needle 103 wherein after cooling the ring-shaped structure 136 compresses the base 113 of the needle 103. Hence, a cylinder compresses another cylinder that resists against the compression, which provides for a suitable fixation of the needle 103 to the body 105. The wider section 135 and the compression of the wall 107 to the base 113 may provide for a lifelong retained position of the needle 103. For example, no additional welding or adhesion needs to be applied where the body 105 and needle 103 interface with each other. Accordingly, near the interface of these two parts the needle 103 and the body 105 are void of dried adhesives or weld rims.

As mentioned above the needle 103 may be of a first polymer based compound and the body 105 may be of a different, second polymer based compound. In an example the different compounds have the same bulk polymer-based material whereas the additives are different. It has been found that using the same bulk material may enhance a bond between the needle 103 and body 105. An example bulk polymer is PET, for example recycled PET. Other example bulk materials include LCP (Liquid Crystal Polymer), PPS (Polyphenylene sulfide), polycarbonate, ABS (Acrylonitrile Butadiene Styrene), Methyl Methacrylate Acrylonitrile Butadiene Styrene, PBT (Polybutylene Terephthalate) and copolyester. The polymer that is used as bulk resin may be impure, for example recycled.

An example additive for the needle 103 is carbon fiber. The carbon fiber may harden the needle 103. An example of a suitable weight percentage of the carbon fiber in the needle 103 is between approximately 12 and 26 percent of the weight of the needle 103, or between approximately 15 and 21 percent of the weight of the needle 103, or approximately 18 percent of the weight of the needle 103. Also other suitable hardening or strengthening additives may be used for the needle compound, instead of or in addition to the carbon fibers.

An example additive for the body 105 is glass fiber. The glass fiber may provide the body 105 with electrical isolation properties. In one example implementing these electrical isolation properties may inhibit that a functioning of the electrodes 131 in the fluid chamber 133 is compromised. An example of a suitable weight percentage of the glass fiber in the body 105 is between approximately 8 and 22 percent of the weight of the body 105, or between approximately 12 and 18 percent of the weight of the body 105, or approximately 15 percent of the weight of the body 105. Also other suitable electrically isolating or more economic additives may be used for the body compound, instead of or in addition to glass fibers.

Figure 5:
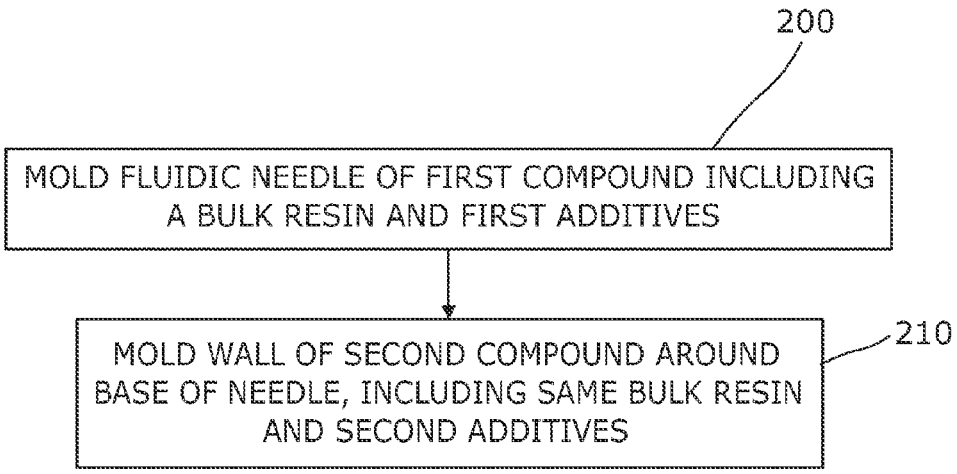
FIG. 5 illustrates a flow chart of an example of manufacturing a fluidic interface.

FIG. 5 illustrates a flow chart of an example of a method of manufacturing a fluidic interface. The method includes molding a fluidic needle of a first polymer based compound that includes a bulk resin and first additives (block 200). The method further includes molding a wall around a base of the needle, the wall being of a second compound of the same bulk resin while containing second additives different than the first additives (block 210). The additives may be fibers. In one example, the first additives may be hardening or strengthening fibers and the second additives may be fibers that are generally cheaper than the first additives or fibers that may improve electrical isolation properties of the second compound.

Figure 6:
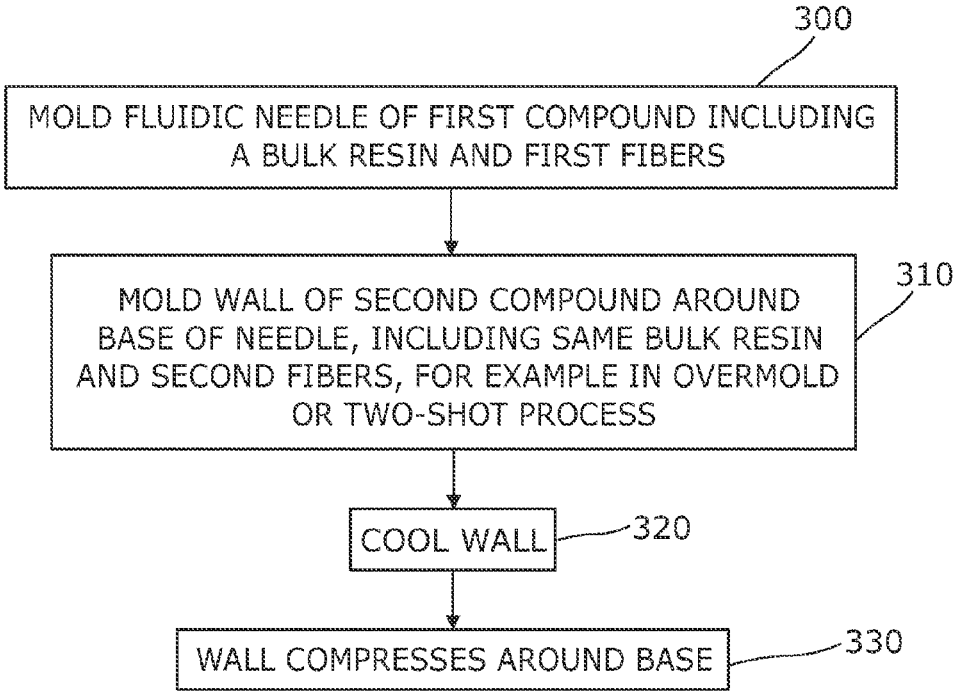
FIG. 6 illustrates a flow chart of another example of manufacturing a fluidic interface.

FIG. 6 illustrates a flow chart of another example of a method of manufacturing a fluidic interface. The method includes molding a fluidic needle of a first polymer based compound that includes a bulk resin and first additives (block 300). The method further includes molding a wall around a base of the needle, the wall being of a second compound of the same bulk resin while containing second additives different than the first additives (block 310). In one example the wall is molded around the needle in the same mold as the needle. Such process may be an overmold process. In the overmold process, two materials are molded within a single mold that is designed to process two consecutive types of resin. For example once the needle is molded, internal mold walls and a gripper that clamps the needle may move to allow the body wall to be molded around the needle within the same mold. In another example, the body wall is molded around the needle in a separate mold at a later time. Such process may be called a two-shot process.

The example method of FIG. 6 further includes cooling the wall after said molding (block 320). The method further includes the wall compressing the needle base, around the needle base (330). The compression may be due to a shrinking effect that occurs due to the cooling. The wall may compress the needle so that a cylinder compresses a cylinder that in turn resists the compression. Thereby a tight coupling of the needle in the body can be achieved.

The invention claimed is:

1. A fluidic interface for a fluid ejection device, comprising a fluidic needle to be inserted in a fluid supply outlet to transport fluid between a fluid supply and a printhead, a body including a body wall, wherein a base of the needle is retained and supported by the body wall, and the needle is made of a first polymer based compound and the body is made of a second polymer based compound, different than the first polymer based compound.

2. The fluidic interface of claim 1 wherein the base of the needle is surrounded by the body wall.

3. The fluidic interface of claim 1 wherein the base includes a flange.

4. The fluidic interface of claim 1 wherein a section of the base inside the body wall has a larger outer diameter than a section of the base at a front surface of the body wall, as measured perpendicular to a central axis of the needle.

5. The fluidic interface of claim 1 wherein an entire interface between the needle and body is void of dried adhesives or weld fused portions of the first polymer based compound and the second polymer based compound.

6. The fluidic interface of claim 1 wherein the needle comprises at least four segments that include an insertion portion to be inserted in a fluid supply outlet, a boss downstream of the insertion portion, the boss having a wider diameter than the insertion portion, a flange downstream of the boss, the flange having a wider diameter than the boss, and a base portion having a wider diameter than the flange.

7. The fluidic interface of claim 1, wherein the first polymer based compound and the second polymer based compound each comprise a same bulk resin.

8. The fluidic interface of claim 7 wherein the first compound includes a first additive and the second compound includes a second additive different than the first additive.

9. The fluidic interface of claim 8 wherein the first additive is a carbon fiber.

10. The fluidic interface of claim 9 wherein the first compound has between 12 and approximately 26 percent of carbon fiber by weight.

11. The fluidic interface of claim 8 wherein the second additive is glass fiber.

12. The fluidic interface of claim 11 wherein the second compound has between 8 and approximately 22 percent of glass fiber by weight.

13. The fluidic interface of claim 1, comprising multiple needles supported by the body wall to be inserted into ink cartridges for transporting ink, the body including multiple ink channels to transport ink to the printhead, each ink channel fluidically connected to a respective needle.

14. The fluidic interface of claim 1, wherein the body wall comprises a first surface formed from the first polymeric compound in direct contact with the needle and wherein the needle comprises a second surface formed from the second polymeric compound in direct contact with the first polymeric compound of the first surface.

15. The fluidic interface of claim 14, wherein the first polymeric compound of the first surface and the second polymeric compound of the second surface are not fused as a result of not being welded.

16. The fluidic interface of claim 1, wherein the fluidic needle has a tip at a first end to be inserted in the fluid supply outlet, wherein the base of the fluidic needle extends adjacent to a second end of the fluidic needle, the second end being opposite the first end and wherein the body wall at least partially receives the base of the fluidic needle.

17. A method of manufacturing a fluidic interface, comprising molding a fluidic needle of a first compound of a bulk resin containing a first additive, and molding a wall around a base of the needle, the wall being of a second compound of the same bulk resin that contains a second additive different than the first additive.

18. The method of claim 17 wherein during solidification and cooling of the wall, the wall compresses around the needle base, thereby fixing the needle to the wall.

19. The method of claim 17, wherein the body wall comprises a first surface formed from the first compound in direct contact with the needle and wherein the needle comprises a second surface formed from the second compound in direct contact with the first compound of the first surface.

20. The method of claim 19, wherein the first compound of the first surface and the second compound of the second surface are not fused as a result of not being welded.

* * * * *